United States Patent [19]

Lenzing

[11] Patent Number: 4,496,923

[45] Date of Patent: Jan. 29, 1985

[54] ELECTRICAL DEVICE WITH IMPROVED HEAT DISSIPATION

[75] Inventor: Richard S. Lenzing, Farmington, Conn.

[73] Assignee: The Superior Electric Company, Bristol, Conn.

[21] Appl. No.: 417,027

[22] Filed: Sep. 13, 1982

[51] Int. Cl.[3] ..... H01F 27/02

[52] U.S. Cl. ..... 336/59; 336/61; 336/96; 336/149

[58] Field of Search ..... 336/59, 61, 96, 148, 336/149

[56] References Cited

U.S. PATENT DOCUMENTS

| | | | |
|---|---|---|---|
| 2,560,926 | 7/1951 | Brownell | 336/59 X |
| 2,835,866 | 5/1958 | Vradenburgh et al. | 336/148 |
| 3,249,817 | 5/1966 | Sinclair et al. | 336/61 X |
| 3,466,585 | 9/1969 | Kucharski | 336/149 X |
| 3,537,051 | 10/1970 | Helberg et al. | 336/149 X |

FOREIGN PATENT DOCUMENTS

| | | | |
|---|---|---|---|
| 662342 | 4/1963 | Canada | 336/149 |
| 35482 | 3/1969 | Fed. Rep. of Germany | 336/149 |

*Primary Examiner*—A. D. Pellinen
*Assistant Examiner*—Susan Steward
*Attorney, Agent, or Firm*—John H. Crozier

[57] ABSTRACT

An improved electrical device of the type having a coil and a base and having a thermally conductive electrical insulating material placed between the coil and the base so as to facilitate the flow of heat from the coil to the base, and further having a base with an extended surface area so as to promote the flow of heat from the base to the surrounding air. In one construction, the insulating material is cast in place, thus cementing the coil and the base together.

2 Claims, 3 Drawing Figures

ELECTRICAL DEVICE WITH IMPROVED HEAT DISSIPATION

BACKGROUND OF THE INVENTION

1. Field of the Invention

This invention relates to electrical devices of the type having a contact brush in electrical engagement with, and relatively movable with respect to, a coil wound upon a magnetic core and mounted upon a base, the movement of which brush varies the output of the device, and more particularly to means for dissipating heat generated in the coil.

2. Description of the Prior Art

Generally, the maximum power that such a device can handle is limited by the temperature rating of the hottest section of the coil. Exceeding this temperature rating can result in fire and/or electrical shortcircuiting. The temperature of the coil is not necessarily uniform and maximum temperatures are produced when the device is operated such that a large current is carried in only a relatively small portion of the coil and a much smaller current is carried in the balance of the coil. This condition typically becomes most extreme when the output voltage of the device is near the input voltage. Since, among other things, the temperature of a wire is approximately proportional to the square of the current it carries, the temperature of the small portion of the coil carrying the large current can be considerably greater than that of the balance of the winding which is carrying the smaller current.

Although the core and the base provide paths for the conduction of heat to the air surrounding the device, their effectiveness in conventional devices is limited. One limitation is a layer of electrical insulation separating the coil from the core, which insulation is usually a relatively efficient thermal insulator. Another limitation is the electrical material typically placed between the coil and the base, which insulation is also usually a relatively efficient thermal insulator. Yet another limitation is the relatively small surface area of the base which limits the quantity of heat that can be transferred from the base to the surrounding air. Likewise, the relatively small surface area of the hot portion of the coil is a further limitation. The net result of these limitations is that the heat generated in the coil has no efficient path for dissipation and a device of a given size can handle less power than it could otherwise if the effect of these limitations could be reduced.

Some prior art designs place the device in a bath of cooling oil to increase heat transfer, but this has the drawback of relatively higher cost and can cause environmental problems.

SUMMARY OF THE INVENTION

The present invention substantially overcomes these limitations in several ways: by increasing the heat-conducting area between the coil and the base, using an electrical insulating material between the coil and the base which material is a relatively good thermal conductor, providing an additional path for heat transfer from the hotter to the cooler portions of the coil and the core, and providing a base with extended surface area for increased dissipation of heat from the base to the surrounding air.

DETAILED DESCRIPTION OF THE DRAWING AND OF THE PREFERRED EMBODIMENT

Figure 1:
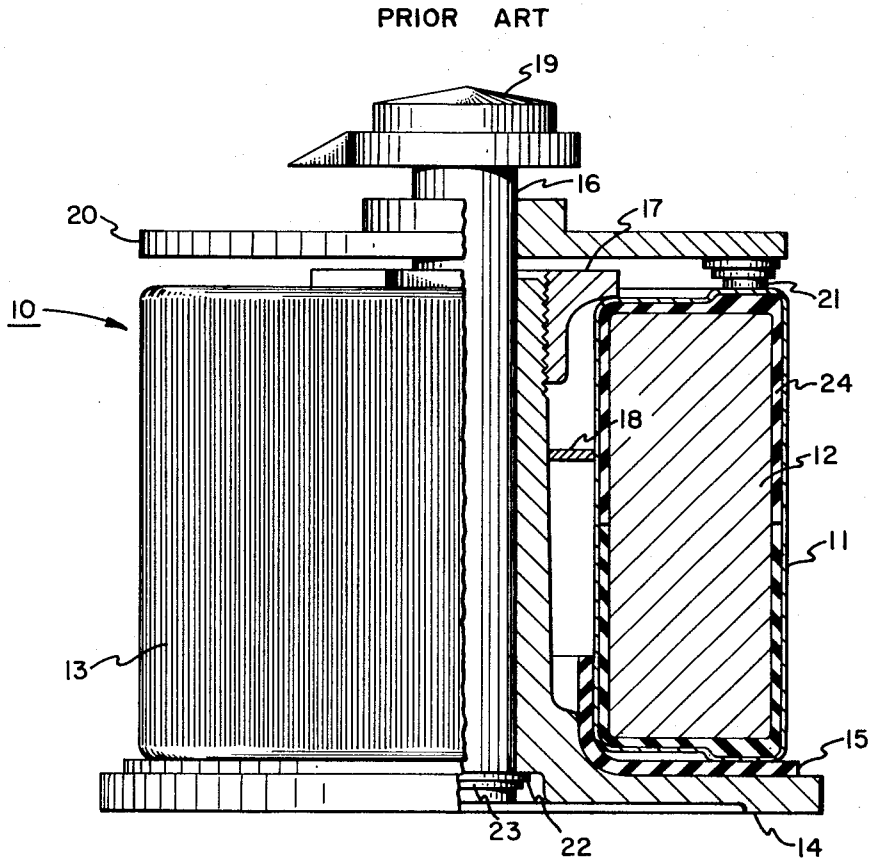
FIG. 1 is a partially cross-sectional elevation of one type of conventionally constructed device of the type described, a variable autotransformer.

Referring now to the drawing, and more particularly to FIG. 1, showing the major elements of one type of conventionally constructed variable autotransformer 10, an electrical conductor 11 is wound upon a magnetic annular core 12, covered with an electrical insulating material 24, to form a toroidal coil 13. The coil 13 is supported by a base 14, but is separated therefrom by an electrical insulator 15. The base 14 includes a cylindrical section which is axially aligned with the coil 13 and which is close fitting to and provides radial support for a shaft 16 which is rotatable relative to the base 14. The coil 13 is held immovable with respect to the base 14 by means of a coil nut 17 which is threaded upon the cylindrical section of the base to prevent relative longitudinal movement between the coil and the base. Centering washer 18 prevents relative radial movement between the coil 13 and the base 14. A knob 19 is fixedly mounted to the shaft 16 for manual rotation thereof. Also fixedly mounted to the shaft 16 is a radiator plate 20 which, when the shaft 16 is rotated, moves a brush 21 along an arcuate path on the surface of the coil 13, with which path the brush is in electrical engagement. The shaft 16 is prevented from upward movement relative to the base 14 by means of a washer 22 and a retaining ring 23.

Figure 2:
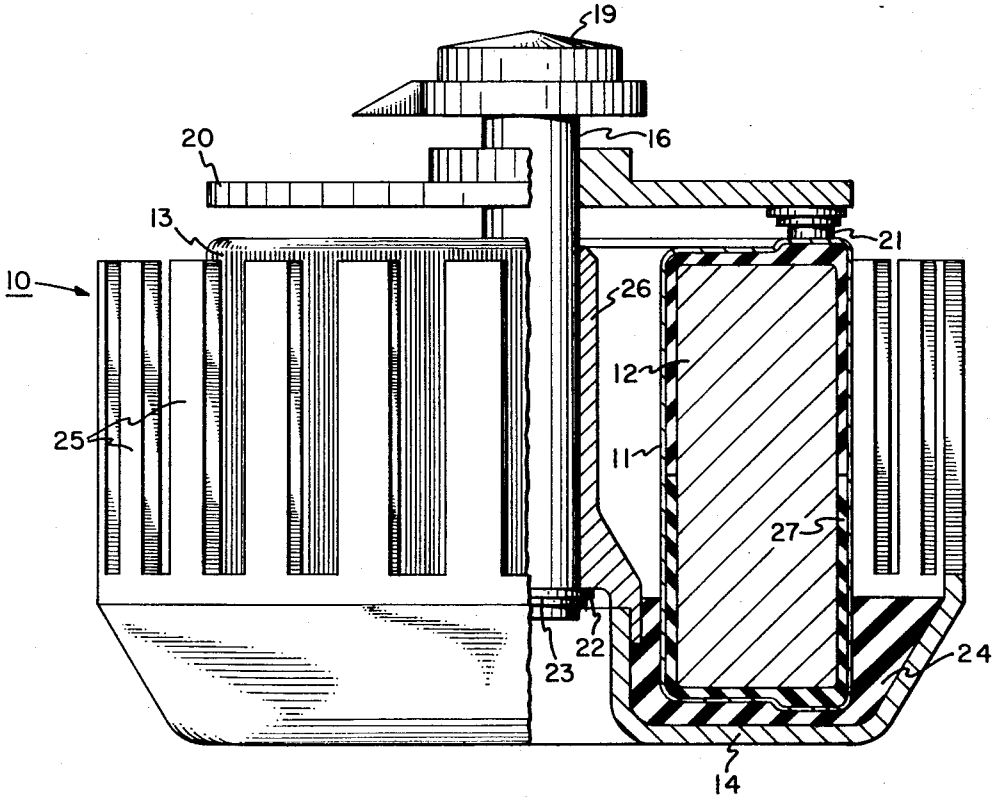
FIG. 2 is a partially cross-sectional elevation of a variable autotransformer showing one embodiment of the improvements of the present invention.
Figure 3:
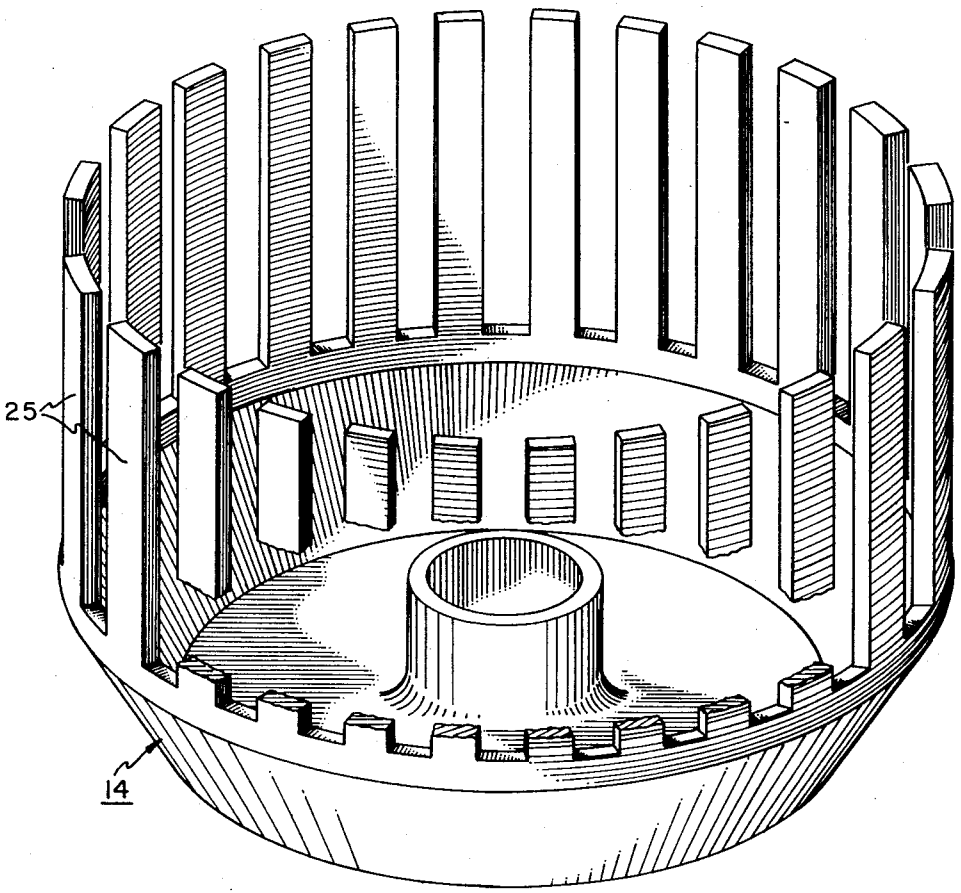
FIG. 3 is a partially cut-away isometric view of the base section of the transformer.

FIG. 2 shows an embodiment of the present invention as applied to one type of an otherwise conventionally constructed variable autotransformer 10. An electrical conductor 11 is wound upon a magnetic annular core 12, covered with an electrical insulating material 27, to form a toroidal core 12. The coil 13 is supported by a base 14 but is separated therefrom by a castable insulating material 24 which has relatively high thermal conductivity and which also cements the coil 13 to the base 14. The base 14 has a plurality of integral fins 25. A centering tube 26 located centrally of the coil 13 is supported by a cylindrically formed section of the base, which section also serves as a dam for the insulating material. The centering tube 26 is fixed in place by the insulating material 24, and is close fitting to and provides radial support for a shaft 16 which is rotatable relative to the coil 13. A knob 19 is fixedly mounted to the shaft 16 for manual rotation thereof. Also fixedly mounted to the shaft 16 is a commutator plate 20 which, when the shaft is rotated, moves a brush 21 along an arcuate path on the surface of coil 13, with which path the brush is in electrical engagement. The shaft is prevented from upward movement relative to the base 14 by means of a washer 22 and a retaining ring 23.

The insulating material 24 can be any electrical insulator which has relatively high thermal conductivity and may be a separate component that is glued or mechanically held in place. Preferably the insulating material is castable so that, after the base, coil, and centering tube are placed in position, the insulating material may be poured into the annular cavity defined by the base, thus, upon curing, rigidly setting those components in place. This technique also effectively eliminates the need for the coil nut and the centering washer. The castable insulating material is preferably a filled epoxy, and excellent results have been obtained with the use of W. R. Grace & Co.'s Stycast 2850FT, a highly-filled epoxy formulation with unusually high thermal conductivity and low thermal expansion.

The extended surface base can be any material of relatively high thermal conductivity, such as aluminum, and should have a flat black finish for maximum thermal emissivity. The extended surface portion of the base may be of any configuration, consistent with manufacturing considerations and the promotion of heat transfer to the surrounding air. The relative thermal expansion properties of the insulating material, the coil/core, and the base should be such that there is a relatively low differential expansion between the coil/core and the insulating material and between the insulating material and the base, thus preserving the integrity of the interfaces between those pairs of components.

The thermally-conductive insulating material provides a relatively large, low-resistance path for the conduction of heat away from the hotter portion of the coil to the cooler portions of the coil and to the extended surface base. Once heat has been conducted to the base, it flows relatively easily to the surface extensions of the base and to the cylindrical center of the base. Since the transfer of heat from the base to the surrounding air is proportional to the surface area of the base, the relatively large surface area thereof promotes such transfer. Heat flowing to the cylindrical center is distributed to cooler portions of the coil and to the centering tube and the shaft.

In one construction of the present invention applied to a variable autotransformer, substantially as shown in FIG. 2, a coil rated at 2.25 amperes for the conventional construction of FIG. 1, was operated at 3.25 amperes without additional increase in coil temperature, for a 44.5 percent increase in capacity. With proper material selection and manufacturing techniques, the cost of manufacture of the FIG. 2 construction is no more than that of FIG. 1, thus providing a unit of substantially increased capacity without increase in cost.

What has been disclosed is a construction for certain electrical devices, which provide improved heat dissipation, which is economical to construct, and which provides greater load carrying capability for a given size unit than would otherwise be achievable with a unit of conventional construction.

Since certain changes may be made in carrying out the above-described invention without departing from the scope thereof, it is intended that all matter contained in the above description or shown in the accompanying Drawing shall be interpreted as illustrative and not in a limiting sense.

It is also to be understood that the following Claims are intended to cover all of the generic and specific features of the invention herein described, and all statements of the scope of the invention which, as a matter of language, might be said to fall therebetween.

I claim:

1. In an electrical device of the type having a contact brush in electrical engagement with, and relatively movable with respect to, a coil wound upon a magnetic core and mounted upon a base, the coil being separated from the base by an electrical insulator, and in which the movement of the brush varies the output of the device, the improvement comprising:

(a) employing for the electrical insulator a castable insulating material of relatively high thermal conductivity, so that heat from a hotter portion of the coil may be readily transferred to a cooler portion of the coil and to the base;

(b) employing for the base a relatively deep trough, the outer wall of which axially surrounds the coil and extends laterally over at least a portion of the coil, so that the coil may be placed therein in noncontacting relationship thereto and the castable insulating material may be placed therein, which material will fill at least the space between the coil and the base and will cement the coil to the base; and (c) the base further including an extended surface area comprising a plurality of fingers extending from the periphery of the base and spaced so as to allow air to circulate therebetween such that heat transferred from the coil to the base may be readily transferred to the surrounding air.

2. A variable transformer, comprising:

(a) an electrical conductor wound upon an electrically insulated, annular, magnetic core to form a coil:

(b) means for moving a contact brush along an arcuate path on the surface of the coil while in electrical engagement therewith;

(c) a base having a bottom and inner and outer cylindrical walls each extending upward from the base to form a relatively deep annular trough into which a portion of the coil extends in noncontacting relationship thereto;

(d) a castable electrical insulator of relatively high thermal conductivity cast in the space between the coil and the base to cement the coil to the base and to readily transfer heat from a hotter portion of the coil to a cooler portion of the coil and to the base; and (e) the base further including an extended surface area comprising a plurality of fingers extending from the periphery of the base and spaced so as to allow air to circulate therebetween such that heat transferred from the coil to the base may be readily transferred to the surrounding air.

* * * * *